US008676531B2

(12) United States Patent
Ueda et al.

(10) Patent No.: US 8,676,531 B2
(45) Date of Patent: Mar. 18, 2014

(54) METHOD AND DEVICE FOR LIVING SPACE ADDED VALUE EFFICACY INDEX EVALUATION

(75) Inventors: Haruka Ueda, Tokyo (JP); Ryouta Dazai, Tokyo (JP); Masato Tanaka, Tokyo (JP)

(73) Assignee: Azbil Corporation, Tokyo (JP)

( * ) Notice: Subject to any disclaimer, the term of this patent is extended or adjusted under 35 U.S.C. 154(b) by 355 days.

(21) Appl. No.: 13/116,441

(22) Filed: May 26, 2011

(65) Prior Publication Data

US 2011/0295544 A1 Dec. 1, 2011

(30) Foreign Application Priority Data

May 27, 2010 (JP) ..... 2010-121302

(51) Int. Cl.
*G06F 11/34* (2006.01)
*G06F 15/00* (2006.01)

(52) U.S. Cl.
USPC ..... 702/130; 62/126; 62/176.6; 702/182

(58) Field of Classification Search
USPC ..... 702/62, 128–130; 62/126, 176.6
See application file for complete search history.

(56) References Cited

U.S. PATENT DOCUMENTS

| | | | |
|---|---|---|---|
| 7,757,504 | B2 | 7/2010 | Yonezawa et al. |
| 2005/0284158 | A1 | 12/2005 | Lee et al. |

FOREIGN PATENT DOCUMENTS

| | | | |
|---|---|---|---|
| JP | 5-126380 | A | 5/1993 |
| JP | 2001-82782 | A | 3/2001 |
| KR | 10-2005-0122605 | A | 12/2005 |
| KR | 10-0867365 | B1 | 11/2008 |

OTHER PUBLICATIONS

Korean Office Action, dated Nov. 13, 2012, which issued during the prosecution of Korean Patent Application No. 10-2011-0027558, which corresponds to the present application.

*Primary Examiner* — John H Le

(74) *Attorney, Agent, or Firm* — Troutman Sanders LLP

(57) ABSTRACT

A measured value for a PMV within a living space is sent to a comfort efficacy evaluating device. Occupancy information (the current number of occupants N) in the living space is sent to the comfort efficacy evaluating device. The comfort efficacy evaluating device calculates a comfort index P as P=1.0−|PMV|/3, and this comfort index P is weighted by the number of occupants N at the time that the comfort index P was taken. In this case, if the number of occupants is relatively high, the weighting is high, and if the number of occupants is relatively low, then the weighting is low. Additionally, the weighted comfort index P is integrated over an evaluation interval, and thus integrated value, or a weighted average based on this integrated value, is used as a comfort efficacy index TP. An evaluation of the efficacy of energy conservation can be performed in the same way, taking into account the current occupancy of the living space.

12 Claims, 13 Drawing Sheets

FIG. 3

(a) Initial State

| | | | | | | | | |
|---|---|---|---|---|---|---|---|---|
| Comfort Index P | 1 | 1 | 1 | 1 | 1 | 1 | 1 | 1 |
| Weighting W | 1 | 1 | 0 | 0 | 0 | 0 | 1 | 1 |
| Weighted Comfort Index P • W | 1 | 1 | 0 | 0 | 0 | 0 | 1 | 1 |

(b) Pattern A

| | | | | | | | | |
|---|---|---|---|---|---|---|---|---|
| Comfort Index P | 1 | 1 | 0 | 0 | 0 | 0 | 1 | 1 |
| Weighting W | 1 | 1 | 0 | 0 | 0 | 0 | 1 | 1 |
| Weighted Comfort Index P • W | 1 | 1 | 0 | 0 | 0 | 0 | 1 | 1 |

(c) Pattern B

| | | | | | | | | |
|---|---|---|---|---|---|---|---|---|
| Comfort Index P | 0 | 0 | 1 | 1 | 1 | 1 | 0 | 0 |
| Weighting W | 1 | 1 | 0 | 0 | 0 | 0 | 1 | 1 |
| Weighted Comfort Index P • W | 0 | 0 | 0 | 0 | 0 | 0 | 0 | 0 |

FIG. 9

Building A

| | | | | | | | | Total |
|---|---|---|---|---|---|---|---|---|
| Comfort Index P | 0.1 | 0.1 | 0.5 | 0.8 | 0.8 | 0.2 | 0.1 | ΣP=2.7 |
| Weighting W | 0.2 | 0.2 | 0.8 | 0.9 | 0.8 | 0.8 | 0.8 | ΣW=4.5 |
| Weighted Comfort Index P・W | 0.02 | 0.02 | 0.4 | 0.72 | 0.72 | 0.16 | 0.08 | ΣP・W=2.12 |

FIG. 10

Building B

| | | | | | | | | Total |
|---|---|---|---|---|---|---|---|---|
| Comfort Index P | 0.1 | 0.1 | 0.5 | 0.8 | 0.8 | 0.2 | 0.1 | ΣP=2.7 |
| Weighting W | 0.8 | 0.8 | 0.1 | 0.1 | 0.1 | 0.8 | 0.8 | ΣW=3.5 |
| Weighted Comfort Index P・W | 0.08 | 0.08 | 0.05 | 0.08 | 0.09 | 0.16 | 0.08 | ΣP・W=0.62 |

METHOD AND DEVICE FOR LIVING SPACE ADDED VALUE EFFICACY INDEX EVALUATION

CROSS REFERENCE TO RELATED APPLICATIONS

The present application claims priority under 35 U.S.C. §119 to Japanese Patent Application No. 2010-121302, filed on May 27, 2010, which is incorporated herein by reference.

FIELD OF TECHNOLOGY

The present invention relates to a method and device for added value index evaluation used to perform an evaluation of the efficacy of added value, such as energy conservation or comfort in a living space.

BACKGROUND OF THE INVENTION

Conventionally, air-conditioning control has been performed using Predicted Mean Vote (PMV) as an index of comfort felt by individuals in living spaces such as office buildings.

This PMV was proposed by a Fanger, where comfort was expressed on a seven-point scale (+3: Extremely Hot, +2: Hot, +1: Warm, 0: Neutral, −1: Cool, −2: Cold, −3: Extremely Cold) through the comfort equation which he published, and thus it is comfortable when the PMV is 0.

Additionally, this PMV is calculated combining six elements within the living space (temperature, relative humidity, average radiant heat, airspeed, amount of human activity, and amount of clothing), thus enabling air-conditioning control to be performed more closely matching human bodily sensation.

For example, in the air-conditioning controlling systems disclosed in Japanese Unexamined Patent Application Publication H5-126380 and Japanese Unexamined Patent Application Publication 2001-82782, the PMV is calculated from the individual measured values for the temperature within the room, the humidity within the room, the average radiant heat, and the airspeed, and the individual setting values for the amount of human activity and the amount of clothing, and the air-conditioning control is performed so that the PMV will be within a comfortable range (−0.5 through +0.5).

In the living space, there is a trade-off relationship between energy conservation and comfort, and, in consideration of global environmental issues, it is desirable to conserve energy as far as is possible (hereinafter termed "energy conservation"). In this case, one must consider sacrificing some degree of comfort; however, if not managed properly the result will be unnecessary sacrifice of comfort. Consequently, when correcting air-conditioning controlling setting values, when renovating air-conditioning equipment, and the like, it is necessary to evaluate not only the energy conservation but comfort as well, to evaluate the need for corrections and renovations, and the scope of renovations, and the like.

In buildings, often the building owners are unable to evaluate easily comfort and energy conservation, so evaluations are performed by the professionals who perform the renovations. Additionally, the renovations themselves require substantial time and expense. Consequently, in order to obtain an agreement between the building owners and the professional contractors regarding the performance of renovations it is desirable to have an objective index for the decision.

Given this, the present applicant contemplates performing an evaluation of comfort efficacy of a living space using the PMV described above. For example, an instantaneous value for a comfort index P that indicates the comfort of a living space can be obtained through substituting the instantaneous value for the PMV into the equation below. This comfort index P has a value that is larger when the comfort is high and smaller when the comfort is low:

$$P=1.0-|PMV|/3 \text{ (wherein } 0\leq|PMV|\leq 3) \quad (1)$$

Given this, the comfort index P is integrated within a specific time period that is established as an evaluation interval, and the integral value for the comfort index P becomes the comfort efficacy index TP (where TP=ΣP). This comfort efficacy index TP is an important index when making decisions when evaluating the need for correcting air-conditioning controlling setting values, renovating air-conditioning equipment, and the like. In this case, it can be evaluated that there is high comfort in the living space if the comfort efficacy index TP is high.

However, in the method described above, currently contemplated by the applicant, no consideration is given in the comfort efficacy index TP to the state of occupancy of the resident, and thus it cannot be said that the comfort of the occupant of the room in the living space is reflected accurately in the comfort efficacy index TP, and thus there is the risk that an error may be made in the decision when deciding whether or not to correct the air-conditioning controlling setting value or renovate the air-conditioning equipment based on this comfort efficacy index TP.

Note that while, in the above, the explanation was for a case wherein an evaluation of the comfort efficacy of a living space was performed, the same problem occurs in the case of evaluating the efficacy of energy conservation in a living space through, for example, integrating the amount of energy consumed.

The present invention was created in order to solve this type of problem, and the object thereof is to provide a method and device for added value efficacy index evaluation in a living space, capable of evaluating accurately the efficacy of added value, such as comfort or energy conservation, in a living space, through taking into consideration the state of occupancy of the occupants.

SUMMARY OF THE INVENTION

In order to achieve such an object, a living space added value efficacy index evaluating method according to the present invention comprises: a control status index acquiring step for acquiring, as a control status index, an index indicating the present status of control in the living space; an occupancy status detecting step for detecting the current status of occupancy by people in the living space; and an added value efficacy index calculating step for calculating an added value efficacy index that indicates the efficacy of a specific added value by weighting the control status index in accordance with the occupancy status in the living space at the time that the control state status index was taken and integrating the weighted control status indices within a specific interval established as an evaluation interval.

For example, in the present invention, the control status index is defined as a comfort index that indicates the current control status of comfort within the living space. This comfort index is weighted in accordance with the occupancy status in the living space at the time at which the comfort status is obtained. For example, the higher the comfort, the greater the value for the comfort index, and the less the comfort, the smaller the value for the comfort index. In this case, when the number of occupants in the living space is relatively high, then the weighting on the comfort index is large, and when the number of occupants is relatively small, then the weighting on the comfort index is small. Moreover, the weighted comfort index is integrated over the evaluation interval to calculate an added value efficacy index (a comfort efficacy index) that indicates the efficacy of the specific added value (the comfort). For example, if the maximum number of occupants in the living space is Nmax and the current number of occupants in the living space is N, then the weighting in the comfort index would be established as W=N/Nmax, where the weighted control status index is integrated over the evaluation interval and that integration value is defined as the value added efficacy index (the comfort efficacy index), or a weighted average based on the integral value is defined as the added value efficacy index (comfort efficacy index).

Additionally, in the present invention the control status index may be defined, for example, as an energy conservation index that indicates the current control status of the energy conservation in the living space. This energy conservation index is weighted in accordance with the occupancy status in the living space at the time at which the energy conservation status is obtained. For example, the lower the degree of energy conservation, such as the higher the amount of energy consumed, the greater the value for the energy conservation index, and the higher the degree of energy conservation, such as the less the amount of energy consumed, the smaller the value for the energy conservation index. In this case, when the number of occupants in the living space is relatively high, then the weighting on the energy conservation index is small, and when the number of occupants is relatively small, then the weighting on the energy conservation index is large. Moreover, the weighted energy conservation index is integrated over the evaluation interval to calculate an added value efficacy index (an energy conservation efficacy index) that indicates the efficacy of the specific added value (the energy conservation). For example, if the maximum number of occupants in the living space is Nmax and the current number of occupants in the living space is N, then the weighting in the energy conservation index would be established as $V=1.0-\alpha \cdot N/Nmax$, with a factor of $\alpha$ (wherein $0<\alpha<1.0$), where the weighted control status index is integrated over the evaluation interval and that integration value is defined as the value added efficacy index (the energy conservation efficacy index), or a weighted average based on the integral value is defined as the added value efficacy index (the energy conservation efficacy index).

While in the present invention the current occupancy status in the living space is detected, this occupancy status detection may be through the provision of occupant detecting sensors, or the like, independently for the detection, or through detecting based on information from an existing system that is provided for the living space. For example, the use of information from a security system that is established in the living space (occupancy information), or operation information of personal PCs (personal computers) from computer network systems established within the living space to detect the status of occupancy in the living space is contemplated.

Additionally, while in the present invention an index indicating the current control status in the living space is acquired as the control status index, instead the control status index may be an index that is obtained continuously as a measured value, or may be an index that is acquired arbitrarily as a reported value from an occupant.

Additionally, in the present invention the control status index is weighted by the occupancy of the living space at the time wherein the control status index is taken, and this weighting may be a binary value established as to whether or not there is a person present in the living space, or may be established in accordance with a numerical formula with a value in accordance with the number of occupants of the living space.

Additionally, the present invention may be embodied as a living space added value efficacy index evaluating device rather than a living space added value efficacy index evaluating method.

In the present invention, an index indicating the current control status in a living space is defined as a control status index, and the current occupancy status in the living space is detected, where the control status index is weighted by the occupancy status in the living space when the control status index was obtained, and the weighted control status index is integrated over an evaluation interval to calculate an added value efficacy index that indicates the efficacy of a specific added value, thus making it possible to take into account the occupancy status of the living space to evaluate accurately the efficacy of an added value such as the comfort or energy conservation of the living space.

BRIEF DESCRIPTION OF THE DRAWINGS

FIG. 3 is a diagram illustrating an example of a living space comfort efficacy evaluation using this comfort efficacy evaluating device (basic example).

FIG. 9 is a diagram showing an example of calculation, using specific numbers, when a comfort efficacy index TP (TPA) for a living space of a building A is required in an example of application of this comfort efficacy evaluating device.

FIG. 10 is a diagram showing an example of calculation, using specific numbers, when a comfort efficacy index TP (TPB) for a living space of a building B is required in an example of application of this comfort efficacy evaluating device.

DETAILED DESCRIPTION OF THE INVENTION

Examples according to the present invention will be explained below in detail, based on the drawings.

Figure 1:
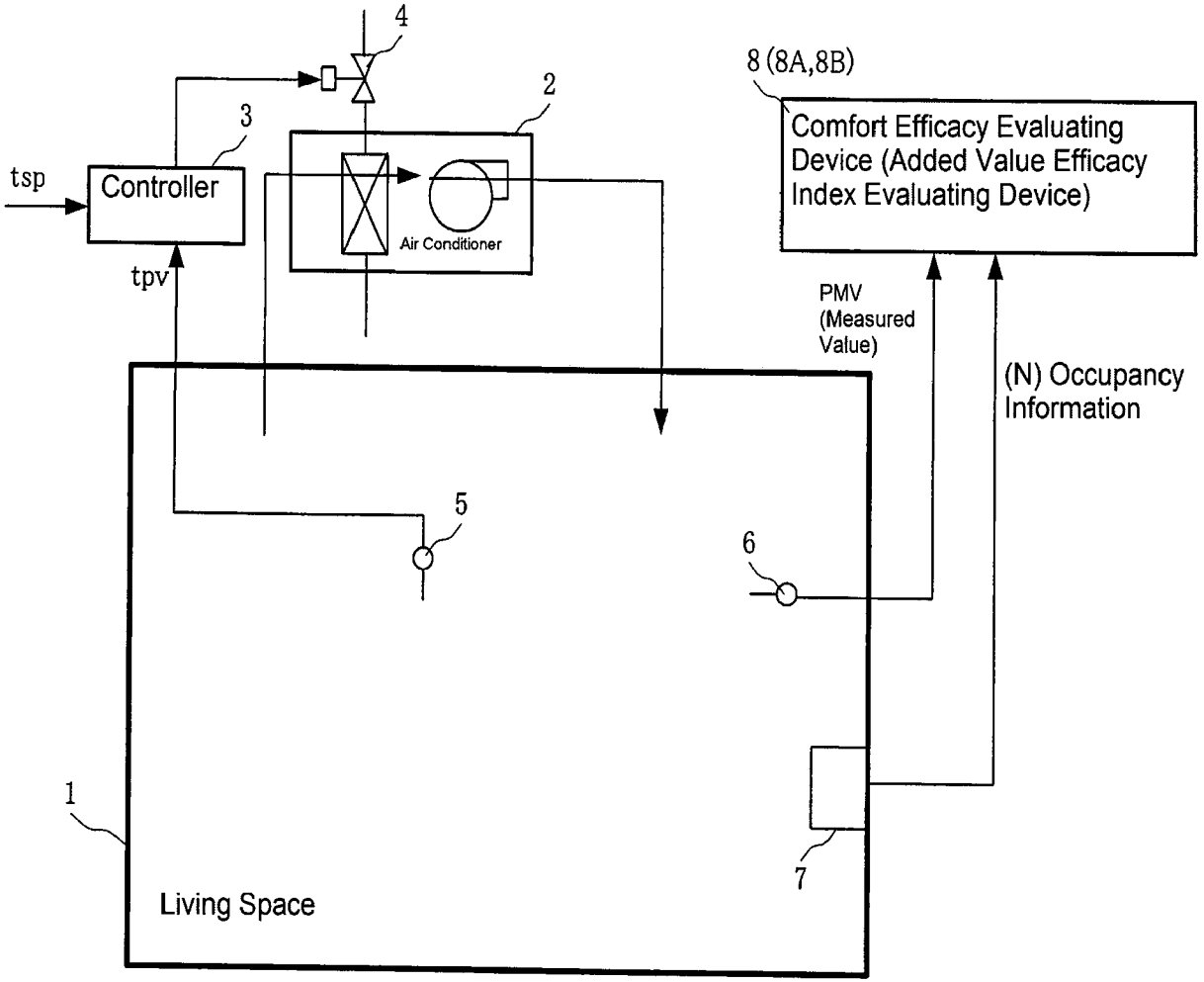
FIG. 1 is a diagram illustrating schematically a system that uses a comfort efficacy evaluating device as an example of an added value efficacy index evaluating device according to the present invention.

FIG. 1 is a diagram illustrating schematically a system that uses a comfort efficacy evaluating device as an example of an added value efficacy index evaluating device according to the present invention.

In this figure: 1 is a living space; 2 is an air conditioner for providing conditioned air to the living space 1; 3 is a controller for controlling the amount of chilled water provided to the air conditioner 2; 4 is a chilled water valve provided in a supply pipe for the chilled water to the air conditioner 2; 5 is a room temperature sensor for detecting, as the room temperature, the temperature within the living space 1; 6 is a room environment sensor for detecting the PMV within the living space 1; 7 is an existing security system provided for the living space 1; and 8 is a comfort efficacy evaluating device provided as an example of an added value efficacy index evaluating device according to the present invention.

In this system, the controller 3 controls the amount of chilled water supplied to the air conditioner 2 through the chilled water valve 4 so that the room temperature TPV within the living space 1, detected by the room temperature sensor 5, will match a setting temperature TSP, to control the temperature of the air supplied from the air conditioner 2 to the living space 1. Additionally, the room environment sensor 6 detects the PMV within the living space 1, and sends the measured value for the PMV (the instantaneous value) to the comfort efficacy evaluating device 8. Additionally, the security system 7 sends, to the comfort efficacy evaluating device 8, information regarding the occupancy of the living space 1 (which, in this example, is the present number of occupants N in the living space 1).

Figure 2:
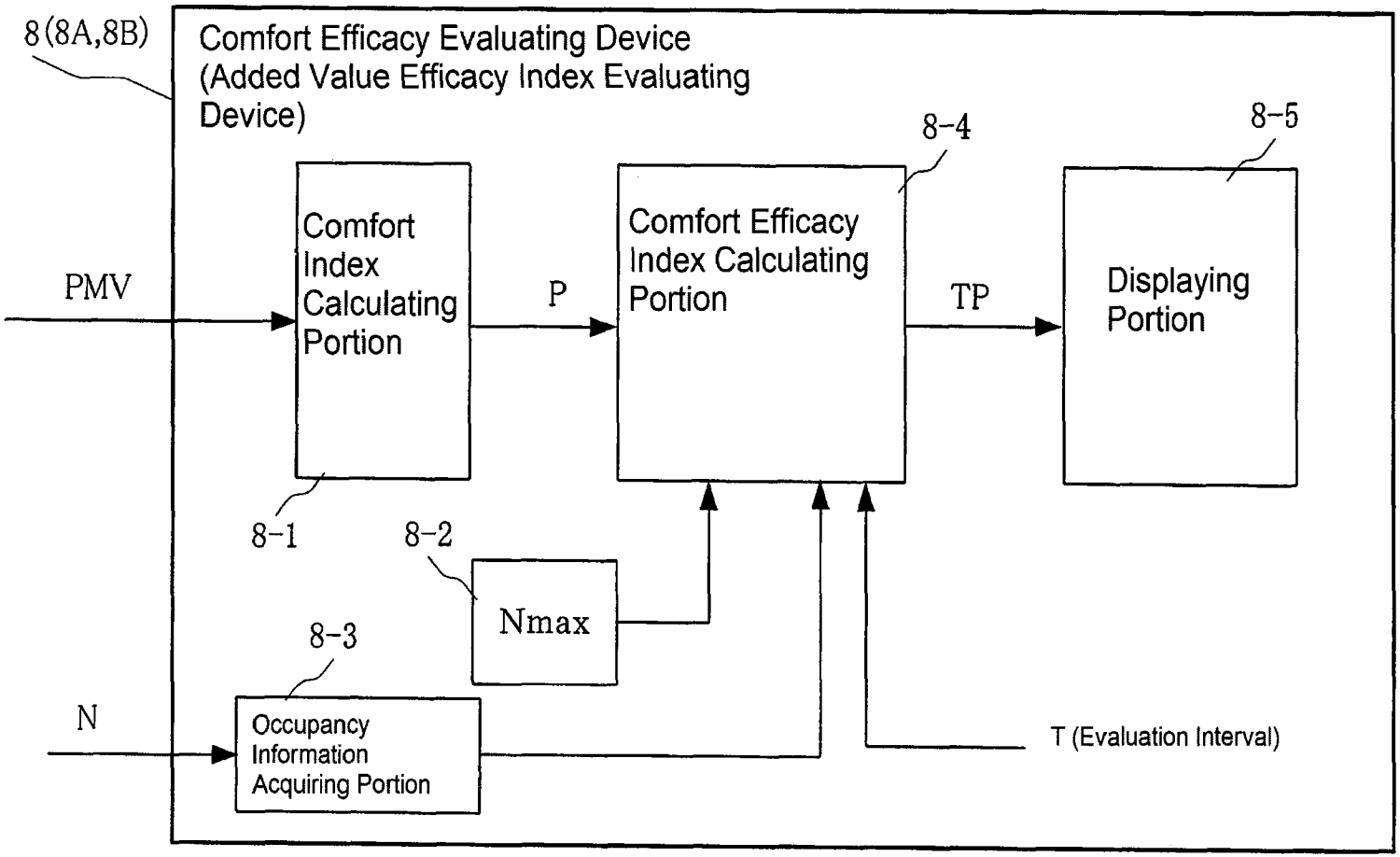
FIG. 2 is a functional block diagram of the comfort efficacy evaluating device in this system.

The comfort efficacy evaluating device 8 is embodied through hardware, comprising a processor and a memory device, and a program that achieves a variety of functions in cooperation with this hardware, and has, as a function that is unique to the present form of embodiment, a comfort efficacy evaluating function. A functional block diagram of this comfort efficacy evaluating device 8 is shown in FIG. 2.

The comfort efficacy evaluating device 8 comprises: a comfort index calculating portion 8-1 for calculating an instantaneous value for a comfort index P of the living space 1 by substituting, into Equation (2), below, the measured value (instantaneous value) for the PMV from the room environment sensor 6; a maximum expected occupancy storing portion 8-2 for storing a maximum expected occupancy Nmax recorded in the living space 1; an occupancy information acquiring portion 8-3 for acquiring the current occupancy information (the number of occupants N) in the living space 1 from the security system 7; a comfort efficacy index calculating portion 8-4 for inputting the comfort index P for the living space 1 from the comfort index calculating portion 8-1, the maximum expected occupancy Nmax for the living space 1, stored in the maximum expected occupancy storing portion 8-2, and the current occupancy N in the living space 1 from the occupancy information acquiring portion 8-3, to calculate, using Equation (3), below, a comfort efficacy index TP in a specific time interval T that is set as an evaluation interval by an administrator; and a displaying portion 8-5 for displaying the comfort efficacy index TP calculated by the comfort efficacy index calculating portion 8-4.

$$P=1.0-|PMV|/3 \text{ (wherein } 0\leq|PMV|\leq3) \quad (2)$$

$$TP=\Sigma(P\cdot W) \quad (3)$$

Note that Equation (2) is identical to Equation (1), above. Moreover, in Equation (3), above, W is the weighting (correcting factor) for the comfort index P, and is calculated as W=N/Nmax. Moreover, in Equation (3), above, P·W is integrated as Σ(P·W), in this case the integration time interval is the evaluation time interval T that is set for the comfort efficacy index calculating portion 8-4. Additionally, the comfort efficacy index TP calculated by Equation (3), above, is used as an index for evaluating the comfort efficacy in the living space 1.

Additionally, in this comfort efficacy evaluating device 8, the comfort index calculating portion 8-1 corresponds to the control status index acquiring means in the present invention, the occupancy information acquiring portion 8-3 corresponds to the occupancy status detecting means, and the comfort efficacy index calculating portion 8-4 corresponds to the added value efficacy index calculating means.

Basic Example

FIG. 3 illustrates an example of a living space comfort efficacy evaluation using this comfort efficacy evaluating device 8. Note that in this comfort efficacy evaluating device 8, Equation (3), above, is used in calculating a comfort efficacy index TP, where this comfort efficacy evaluating device 8 that calculates the comfort efficacy index TP using this Equation (3) is defined as a basic example of the comfort efficacy evaluating device. Note that the basic example of the comfort efficacy evaluating device is defined, in the below, as the comfort efficacy evaluating device 8A, in order to draw a distinction from the examples of application set forth below.

Here it is assumed that an evaluation such as illustrated in FIG. 3 (*a*) is obtained in the initial state in the living space 1. Note that in the FIG. 3 (*a*) W is the weighting applied to the comfort index P in accordance with the occupancy of the living space 1, where "1" indicates the case wherein there is a large number of occupants and "0" indicates the case wherein there is a small number of occupants.

Figure 4:
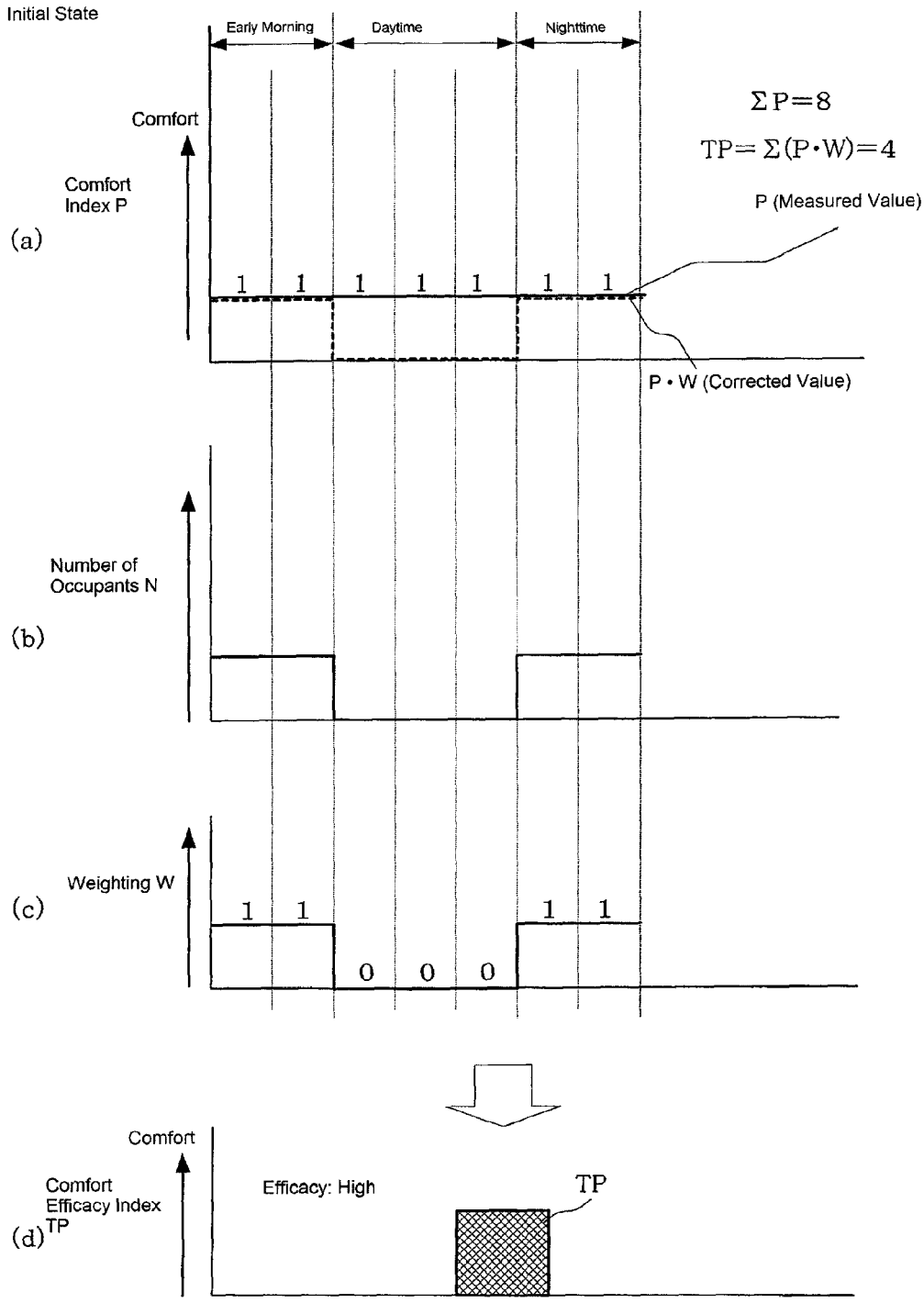
FIG. 4 is a diagram illustrating the state (in the initial state) wherein a comfort efficacy index for a living space is required in the basic example of this comfort efficacy evaluating device.

The state wherein the comfort efficacy index TP is calculated in this initial state is illustrated in FIG. 4. FIG. 4 (*a*) shows the changes in the comfort index P; FIG. 4 (*b*) shows the changes in the number of occupants N; FIG. 4 (*c*) shows the changes in the weighting W; and FIG. 4 (*d*) shows the calculated comfort efficacy index TP. In the initial state, ΣP=8, where the comfort efficacy index TP is calculated as TP=Σ(P·W)=4. Note that in FIG. 4 (*a*), P·W is a corrected value, and the changes of this corrected value P·W over time are indicated by the dotted line.

Figure 5:
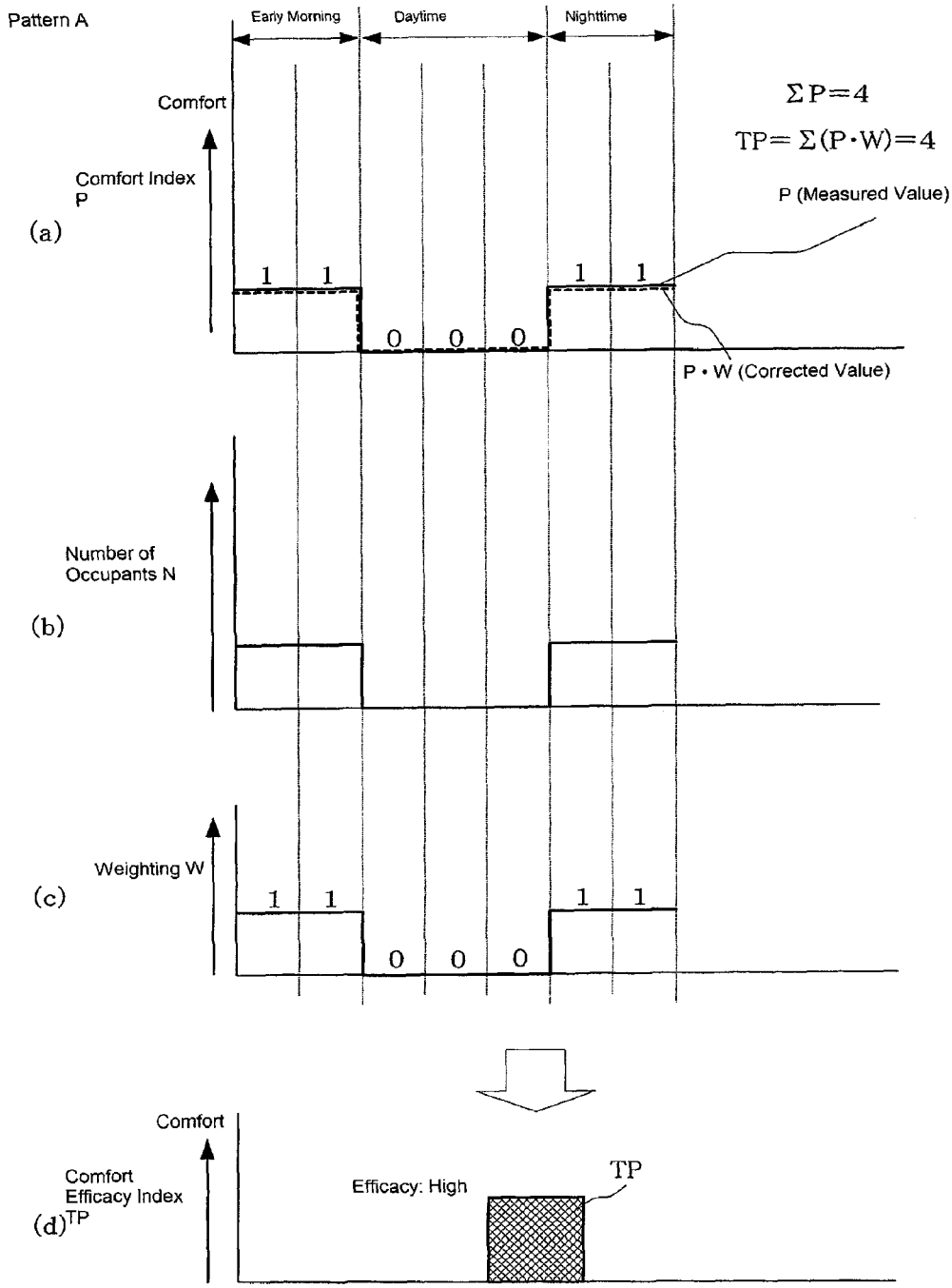
FIG. 5 is a diagram illustrating the state (Pattern A) wherein a comfort efficacy index for a living space is required in the basic example of this comfort efficacy evaluating device.

Next, as time elapses, the comfort index P changes as illustrated in FIG. 3 (*b*). The state wherein the comfort efficacy index TP is calculated in this case is illustrated in FIG. 5. In this case, ΣP=4, and the comfort efficacy index TP is calculated as Σ(P·W)=4. This is defined as "Pattern A."

Figure 6:
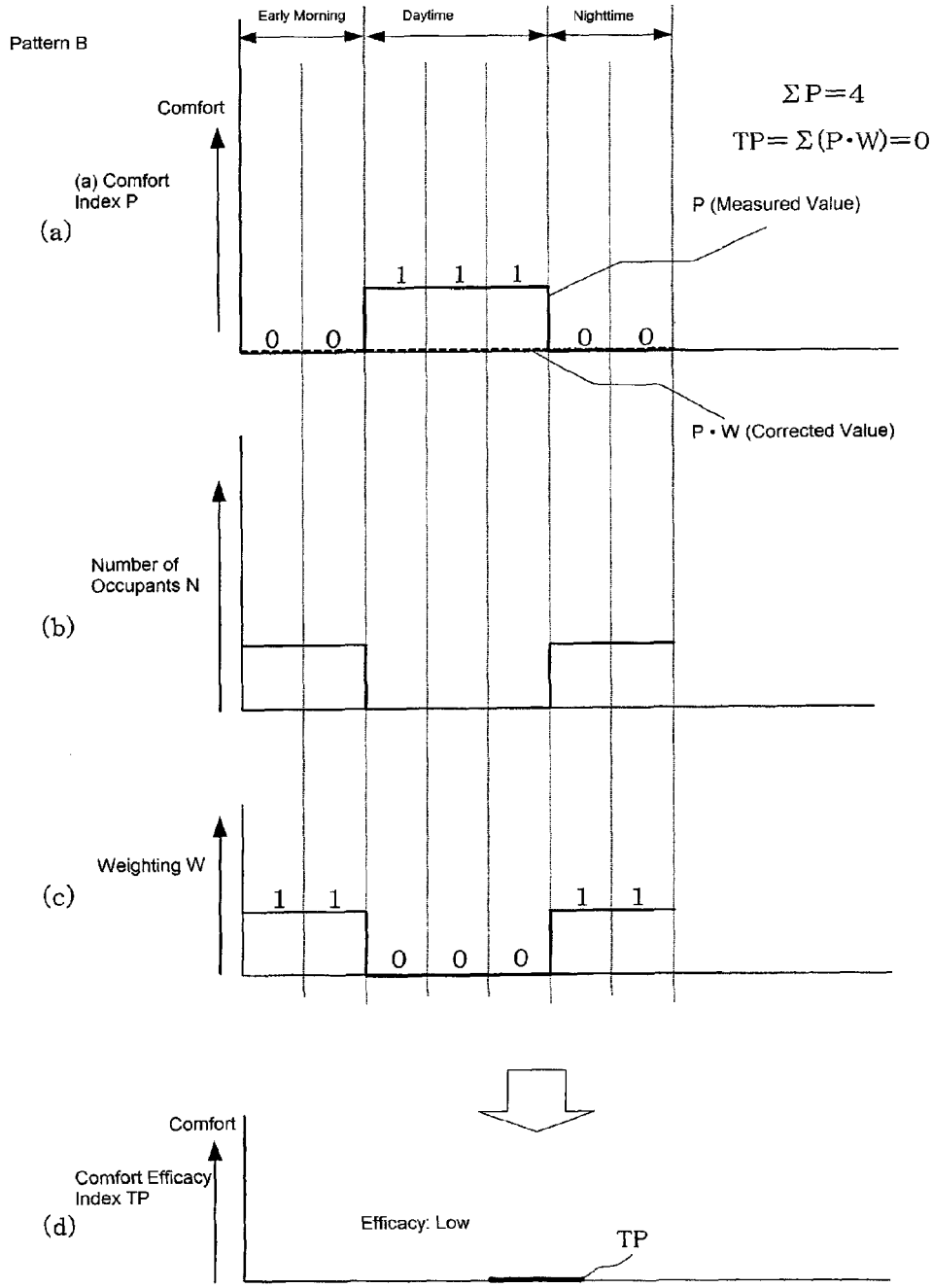
FIG. 6 is a diagram illustrating the state (Pattern B) wherein a comfort efficacy index for a living space is required in the basic example of this comfort efficacy evaluating device.

Additionally, as time elapses at another time, the comfort index P changes as illustrated in FIG. 3 (*c*). The state wherein the comfort efficacy index TP is calculated in this case is illustrated in FIG. 6. In this case, ΣP=4, and the comfort efficacy index TP is calculated as Σ(P·W)=0. This is defined as "Pattern B."

In both Pattern A and Pattern B, ΣP=4, but because the evaluation has dropped from the initial status ΣP=8, when one looks at TP=ΣP, the need for corrections is evaluated identically for both. On the other hand, when looking at TP=Σ(P·W), there is no change in Pattern A from the initial status of TP=Σ(P·W)=4, where in Pattern B, TP=(P×W)=0, so the evaluation has fallen.

That is, in this comfort efficacy evaluating device 8A, calculating the comfort efficacy index TP as Σ(P·W) makes it possible to evaluate that there is no need for renovations, or the like, when there is no change in the comfort efficacy if the changes over time follow Pattern A, and to evaluate that there is the need for renovations, or the like, because the comfort efficacy will have declined, if the changes over time follow Pattern B.

In this way, in this comfort efficacy evaluating device 8A, it is possible to evaluate accurately the comfort efficacy through taking into consideration the status of occupancy by the occupants in the comfort efficacy index TP, with TP=Σ(P·W).

Examples of Application

Although in the basic example set forth above, the comfort efficacy index TP was calculated as Σ(P·W), instead the comfort efficacy index TP may be calculated as a weighted average based on Σ(P·W), as in Equation (4), shown below. The comfort efficacy evaluating device 8 that performs the calculation of the comfort efficacy index TP using this Equation (4) is an example of application of the comfort efficacy evaluating device. The example of application of the comfort efficacy evaluating device is defined, in the below, as the comfort efficacy evaluating device 8B, in order to draw a distinction from the basic example set forth above, $$TP=\Sigma(P\cdot W)/\Sigma W \tag{4}$$

Figure 7:
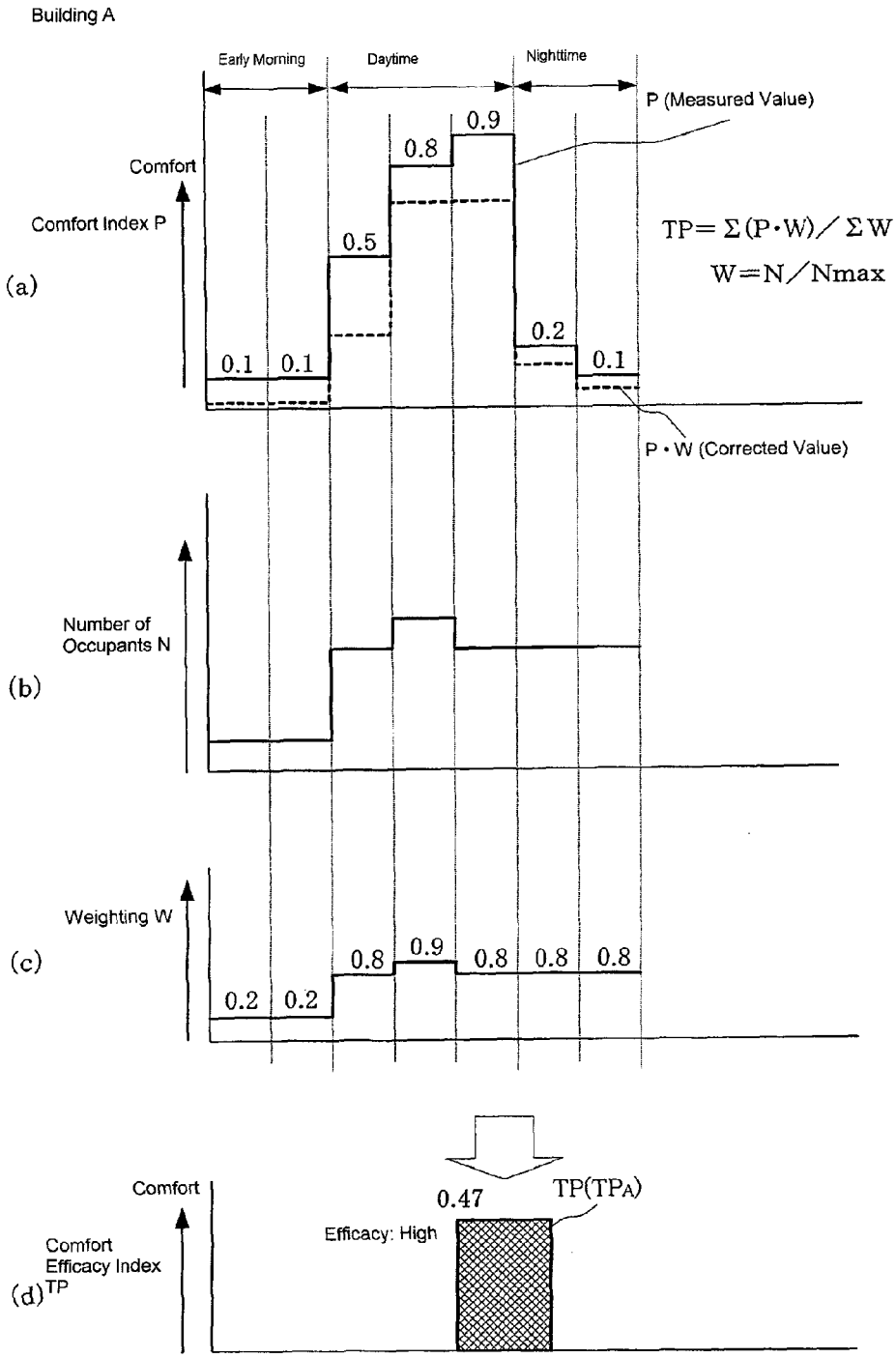
FIG. 7 is a diagram illustrating the state wherein a comfort efficacy index TP (TPA) for a living space of a building A is required in an example of application of this comfort efficacy evaluating device.
Figure 8:
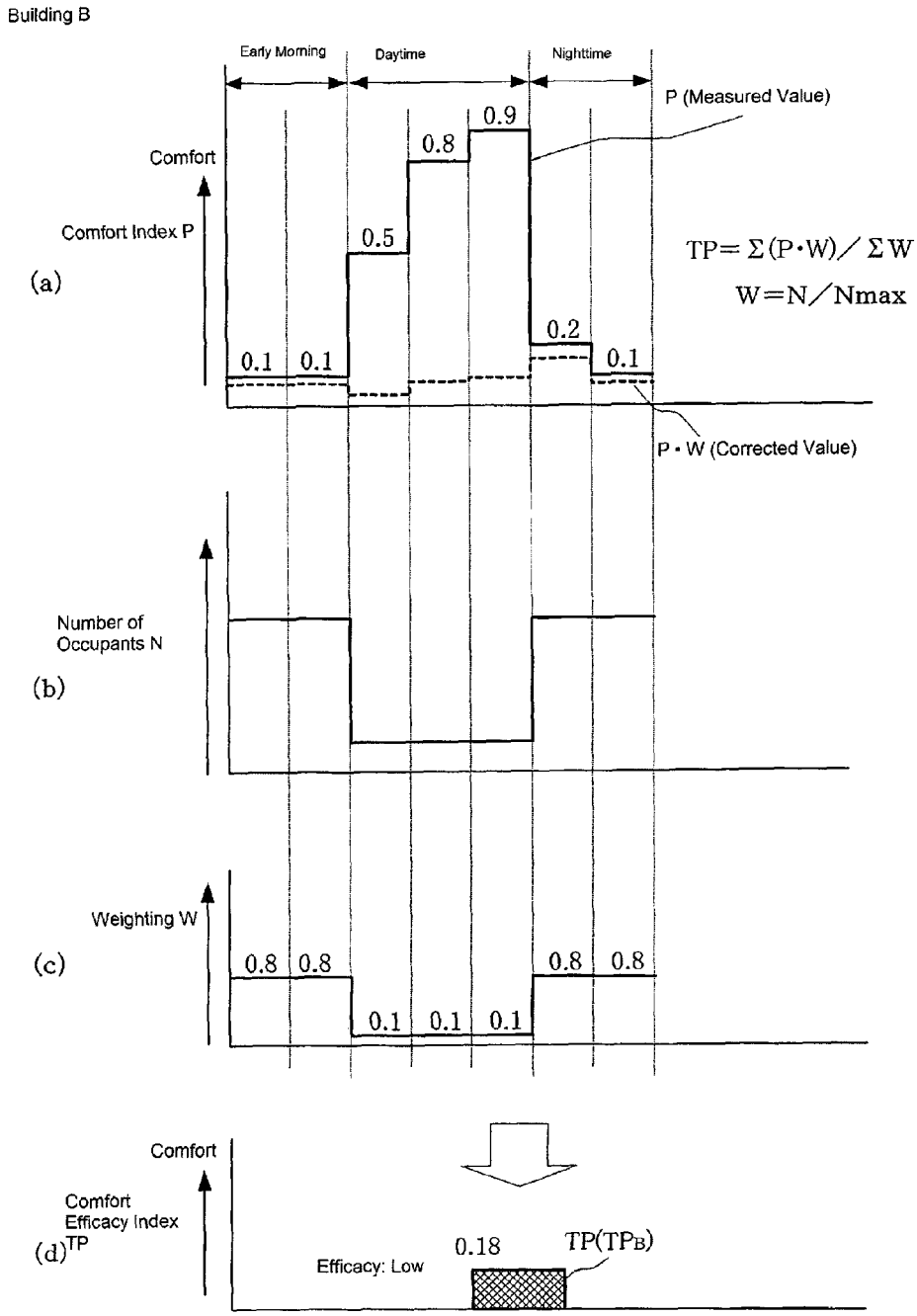
FIG. 8 is a diagram illustrating the state wherein a comfort efficacy index TP (TPB) for a living space of a building B is required in an example of application of this comfort efficacy evaluating device.

FIG. 7 illustrates the state wherein a comfort efficacy index TP for a living space 1 of a building A is required in an example of application of this comfort efficacy evaluating device 8B. FIG. 8 illustrates the state wherein a comfort efficacy index TP for a living space 1 of a building B is required in an example of application of this comfort efficacy evaluating device 8B.

For ease in understanding the explanation, in this example let its assume that the comfort index P moves with identical patterns in the living space it in the building A and the living space 1 in the building B. (See FIG. 7 (*a*) and FIG. 8 (*a*).)

The patterns of change of the number of occupants N are different in the living space 1 in building A and the living space 1 in building B (referencing FIG. 7 (*b*) and FIG. 8 (*b*)), where the number of occupants in the living space 1 in building A is large during the daytime, and the number of occupants in the living space 1 of building B is small during the daytime (where there are nearly no occupants during most of the day), In this case, when the comfort efficacy index TP is calculated as TP=ΣP, there will be identical values for both the living space 1 in building A and the living space 1 in building B, so there is no difference in the comfort efficacy index TP between the living space 1 in building A and the living space 1 in building B. In the numeric examples for the comfort index P shown in FIG. 7 (*a*) and FIG. 8 (*a*), ΣP=2.7 for both. (See FIG. 9 and FIG. 10.)

In contrast, in the comfort efficacy evaluating device 8B, the comfort efficacy index TP is calculated as TP=Σ(P·W)/ΣW. In this case, the weighting W for the comfort index P is defined as W=N/Nmax, where the weighting W is large in the case wherein the number of occupants N is relatively large in the living space 1, and the weighting W is small in the case wherein the number of occupants N is relatively small in the living space 1. The changes in the weightings W in the building A are shown together with numeric examples in FIG. 7 (*c*), and the weightings W in the building B are shown together with numeric examples in FIG. 8 (*c*).

As a result, the comfort indices P for the living spaces 1 for both of the buildings A and B are corrected to the comfort indices P·W, indicated by the dotted lines in FIG. 7 (*a*) and FIG. 8 (*a*), where the comfort efficacy index TP for building A goes to TP=Σ(P·W)/ΣW=2.12/4.5=0.47 (referencing FIG. 9), and the comfort efficacy index TP for building B goes to TP=Σ(P·W)/ΣW=0.62/3.5=0.18 (referencing FIG. 10), where the comfort efficacy index TP for building A (TPA) goes to a high value (referencing FIG. 7 (*d*)), white, in contrast, the comfort efficacy index TP for building B (TPB) goes to a low value (referencing FIG. 8 (*d*)).

In this way, in the comfort efficacy evaluating device 8B, the comfort efficacy index TP will be a large value for building A wherein there are many occupants during the day, and the comfort efficacy index TP will be a small value for building B wherein there are nearly no residents during most of the day, making it possible to evaluate accurately the comfort efficacy for the living spaces 1 by taking into consideration the status of occupancy, with the comfort efficacy high for building A and the comfort efficacy low for building B.

Note that in the comfort efficacy evaluating devices 8 (8A and 8B), set forth above, the comfort efficacy indices TP calculated by the comfort efficacy index calculating portion 8-4 is displayed by the displaying portion 8-5, and thus the individual viewing this comfort efficacy index TP is able to determine whether or not there is the need to correct the air-conditioning controlling setting value or to renovate the air-conditioning equipment. In this case, a threshold value to be used as a decision criterion may be displayed, and the decision as to whether or not the air-conditioning controlling setting value needs to be corrected or the air-conditioning equipment requires renovation may be performed through comparison with the threshold value. Furthermore, the comparison with the threshold value may be performed by the comfort efficacy index calculating portion 8-4, and the comparison result may be displayed on the displaying portion 8-5.

Additionally, the comfort efficacy index TP of the living space 1 calculated by the comfort efficacy evaluating device 8 (8A or 813) may be sent to a center through a communication network and the decision regarding the comfort efficacy index TP may be made on a screen at the center, and may be printed out as an operating report, or the like. Furthermore, in air-conditioning control that operates while switching between comfort control and energy conservation control, the comfort efficacy index TP may be used also in order to correct the switching index.

Additionally, while in the example set forth above the comfort index P was calculated from the PMV, instead it may be calculated from the predicted percentage of dissatisfied (PPD), or the comfort index P may be calculated from the temperature within the room and the humidity within the room. Additionally, an independent instantaneous evaluation formula may be implemented so as to calculate the comfort index P. Additionally, results of surveys of residents or reported values from residents may be used as the comfort index P. In any case, implementation is easier if the comfort index P is designed appropriately so that the value is larger the greater the comfort and the value is smaller the less the comfort.

If the result of a survey of residents or a reported value from a resident is used as the comfort index P, then, for example, the input of a reported value Q for comfort-related topics (the feeling of being hot or cold, the degree of satisfaction, the ease of working, etc.) may be from, for example, a personal computer through the web or through a corporate information infrastructure, and, as illustrated in Equation (5), below, a sum of the reported values Q may be divided by the number of occupants (the number of individuals making reports) N, to obtain the comfort index P, for example.

$$P=\Sigma Q/N \quad (5)$$

Additionally, if reported values are not received from all of the occupants, then it can be assumed that the non-reporting occupants Nq are, at least, not uncomfortable, and thus the neutral design value Qc for the comfort (neither comfortable nor uncomfortable) may be used in an evaluation equation such as, for example, Equation (6), below. The evaluation equation in this case can be designed as appropriate depending on the residents and the particular characteristics of the building:

$$P=(\Sigma Q+Qc\cdot Nq)/N \quad (6)$$

Furthermore, even in regards to the formula for calculating the comfort efficacy index TP, essentially this is a quantification method that takes into account the number of occupants, and Equation (3) and Equation (4) are no more than examples, and can be designed as appropriate.

Evaluation of Energy Conservation Efficacy

Figure 11:
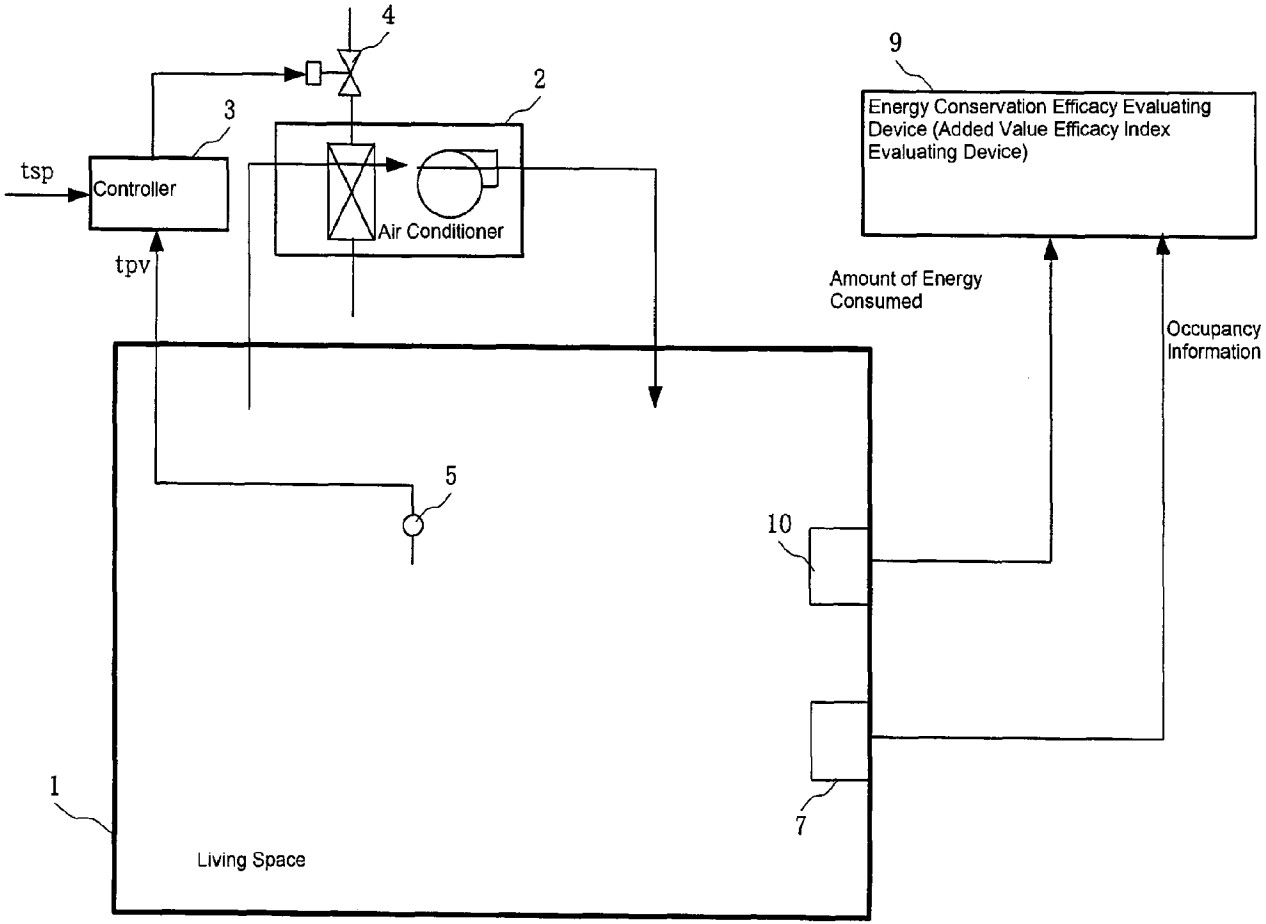
FIG. 11 is a diagram illustrating schematically a system that uses an energy conservation efficacy evaluating device as another example of an added value efficacy index evaluating device according to the present invention.

FIG. 11 is a diagram illustrating schematically a system that uses an energy conservation efficacy evaluating device as another form of embodiment of an added value efficacy index evaluating device according to the present invention. In this figure, codes that are the same as those in FIG. 1 indicate identical or equivalent structural elements as the structural elements explained in reference to FIG. 1, and explanations thereof are omitted.

In the present example, an energy conservation efficacy evaluating device 9 is provided as another example of the added value efficacy index evaluating device according to the present invention, instead of the comfort efficacy evaluating device 8 illustrated in FIG. 1. Additionally, in the energy conservation efficacy evaluating device 9, a measured value (instantaneous value) for the amount of energy consumed (the amount of electrical power consumed, the amount of gas used, the amount of water used, etc.) in the living space 1 is sent from an energy sensor 10, such as an electric meter or a gas meter, instead of the measured value (instantaneous value) for the PMV from the room environment sensor 6 illustrated in FIG. 1.

Additionally, as with the comfort efficacy evaluating device 8 illustrated in FIG. 1, the energy conservation efficacy evaluating device 9, is such that the security system 7 sends, to the comfort efficacy evaluating device 8, information regarding the occupancy of the living space 1 (which, in this example, is the present number of occupants N in the living space 1).

Figure 12:
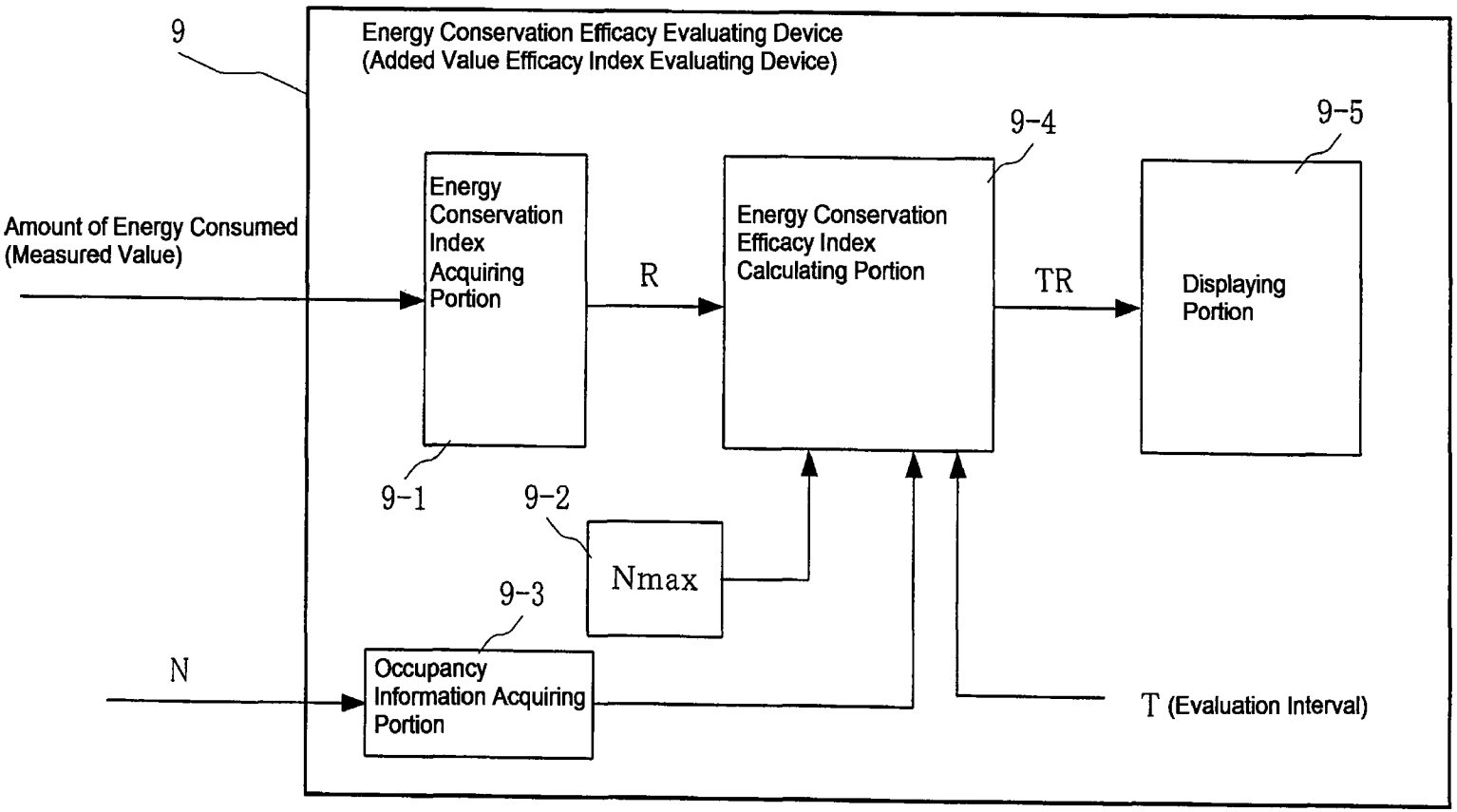
FIG. 12 is a functional block diagram of the energy conservation efficacy evaluating device in this system.

The energy conservation efficacy evaluating device 9 is embodied through hardware, having a processor and a memory device, and a program that achieves a variety of functions in cooperation with this hardware, and has, as a function that is unique to this example, and energy conservation efficacy evaluating function. A functional block diagram of this energy conservation efficacy evaluating device 9 is shown in FIG. 12.

The energy conservation efficacy evaluating device 9 includes an energy conservation index acquiring portion 9-1 for acquiring, as an instantaneous value for an energy conservation index R of the living space, a measured value (instantaneous value) for the amount of energy consumed from an energy sensor 10; a maximum expected occupancy storing portion 9-2 for storing a maximum expected occupancy Nmax recorded in the living space 1; an occupancy information acquiring portion 9-3 for acquiring the current occupancy information (the number of occupants N) in the living space 1 from the security system 7; an energy conservation efficacy index calculating portion 9-4 for inputting the energy conservation index R for the living space 1 from the energy conservation index acquiring portion 9-1, the maximum expected occupancy Nmax for the living space 1, stored in the maximum expected occupancy storing portion 9-2, and the current occupancy N in the living space 1 from the occupancy information acquiring portion 9-3, to calculate, using Equation (7), below, an energy conservation efficacy index TR in a specific time interval T that is set as an evaluation interval by an administrator; and a displaying portion 9-5 for displaying the energy conservation efficacy index TR calculated by the energy conservation efficacy index calculating portion 9-4.

$$TR=\Sigma(R\cdot V) \quad (7)$$

Note that, in Equation (7), above, V is the weighting (correcting factor) for the energy conservation index R, and is calculated as W=1.0−0.8·(N/Nmax). Moreover, in Equation (7), above, R·V is integrated as Σ(R·V), in this case the integration time interval is the evaluation time interval T that is set for the energy conservation efficacy index calculating portion 9-4. Additionally, the energy conservation efficacy index TR calculated by Equation (7), above, is used as an index for evaluating the energy conservation efficacy in the living space 1.

Furthermore, Equation (7), above, may be defined as a basic example, and Equation (8), below, may be used as an example of application:

$$TR=\Sigma(R\cdot V)/\Sigma W \quad (8)$$

Additionally, in this energy conservation efficacy evaluating device 9, the energy conservation index acquiring portion 9-1 corresponds to the control status index acquiring means in the present invention, the occupancy information acquiring portion 9-3 corresponds to the occupancy status detecting means, and the energy conservation efficacy index calculating portion 9-4 corresponds to the added value efficacy index calculating means.

Figure 13:
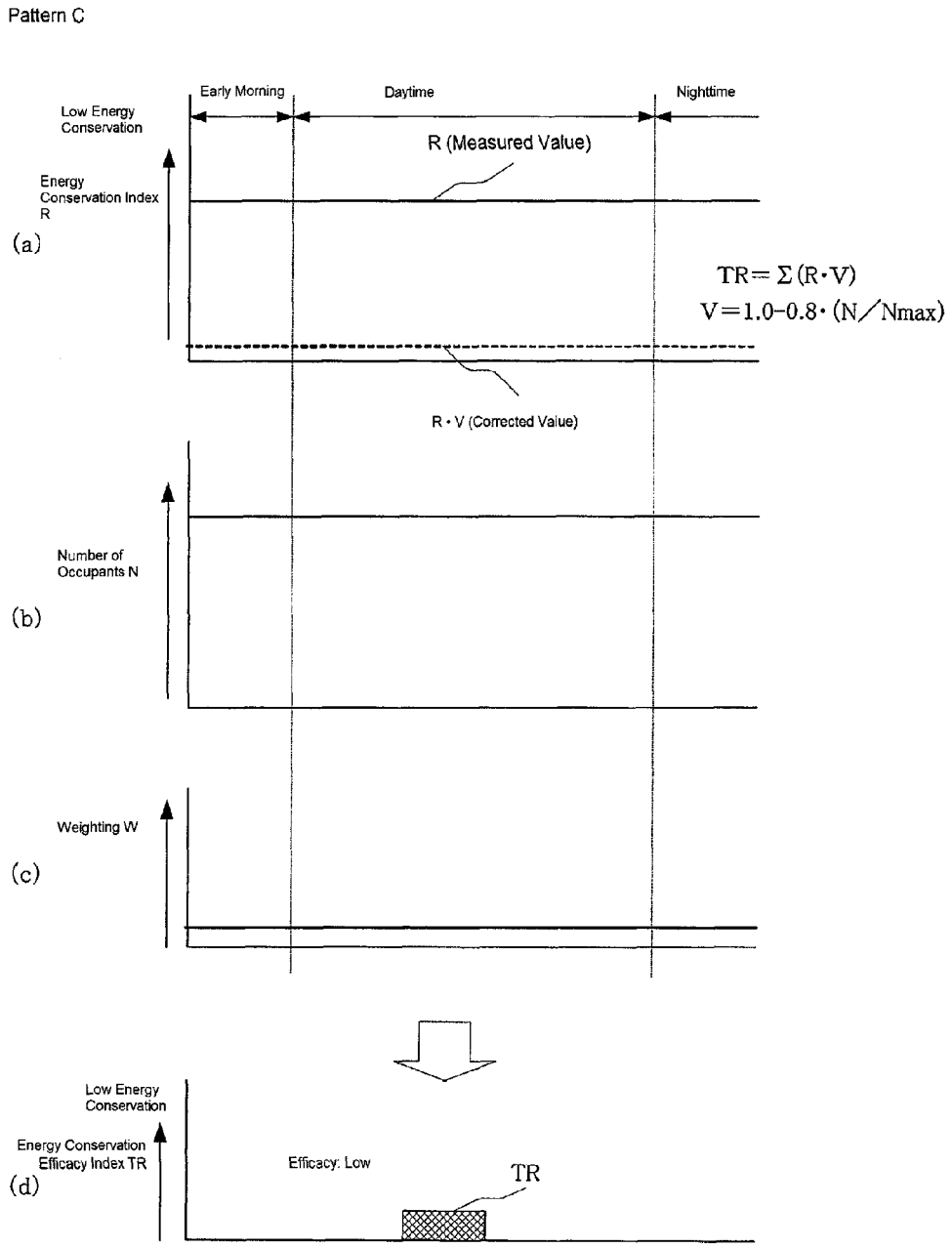
FIG. 13 is a diagram (Pattern C) wherein an energy conservation index TR for a living space is required in this energy conservation efficacy evaluating device.

FIG. 13 illustrates an example wherein energy conservation efficacy index TR for the living space 1 is required in this energy conservation efficacy evaluating device 9. In this example, as illustrated in FIG. 13 (*b*), the number of occupants N is always large. This is defined as "Pattern C,"

Figure 14:
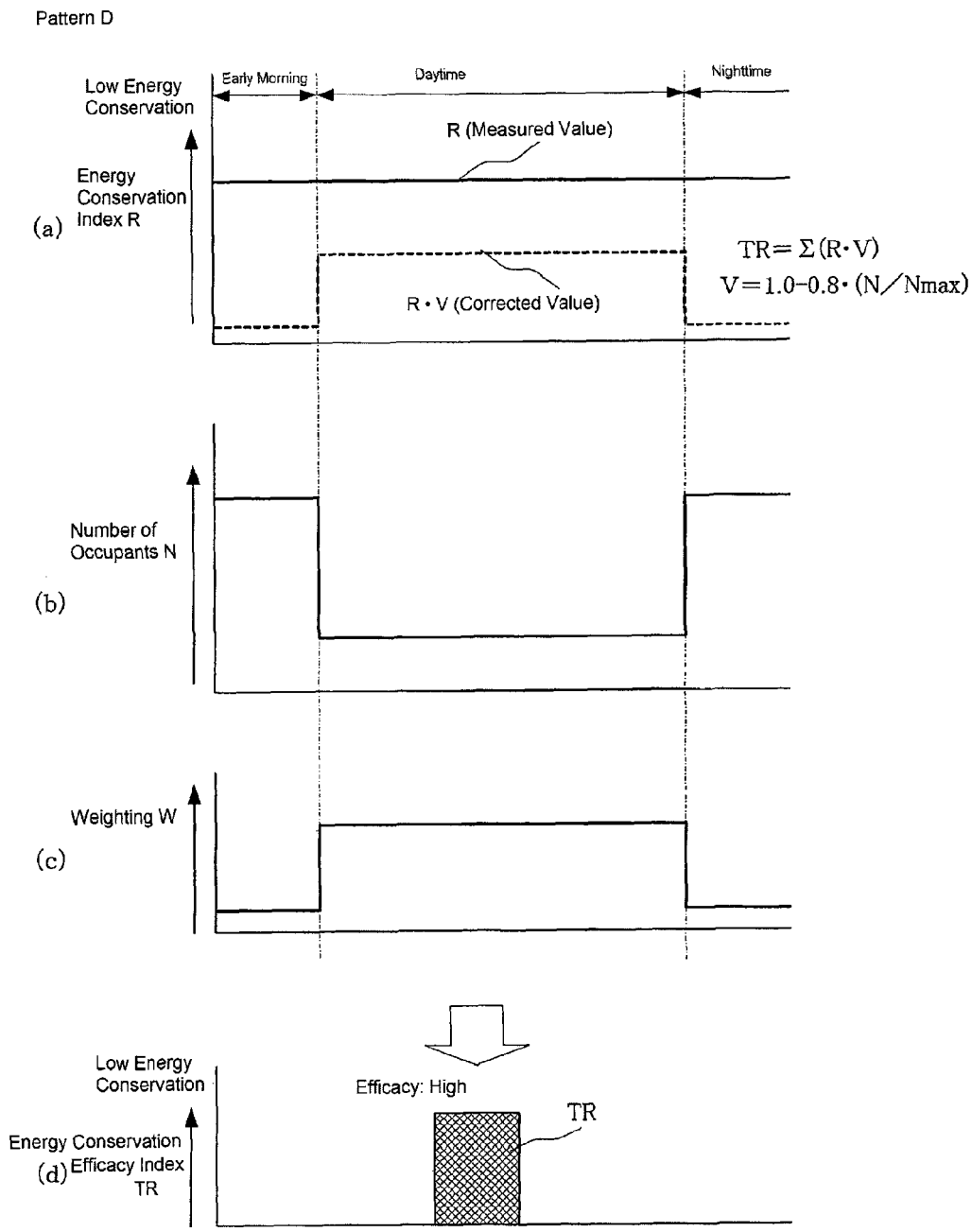
FIG. 14 is a diagram (Pattern D) wherein an energy conservation efficacy index TR for a living space is required in this energy conservation efficacy evaluating device.

FIG. 14 illustrates another example wherein an energy conservation efficacy index TR for the living space 1 is required in this energy conservation efficacy evaluating device 9. In this example, as illustrated in FIG. 14 (*b*), the number of occupants N during the day is small. This is defined as "Pattern D."

Note that for ease in understanding the explanation, in this example let us assume that the energy conservation index R moves with identical patterns in the living space 1 in Pattern C and the living space 1 in Pattern D. (FIG. 13 (*a*) and FIG. 14 (*a*).)

In this case, when the energy conservation efficacy index TR is calculated as TR=ΣR, there will be identical values for both the living space 1 in Pattern C and the living space 1 in Pattern D, so there is no difference in the energy conservation efficacy index TR between the living space 1 in Pattern C and the living space 1 in Pattern D.

In contrast, in the present form of embodiment, the energy conservation efficacy index TR is calculated as TR=Σ(R·V).

In this case, the weighting V for the comfort index R is defined as V=1.0−0.8·(N/Nmax), where the weighting V is small in the case wherein the number of occupants N is relatively large in the living space 1, and the weighting V is large in the case wherein the number of occupants N is relatively small in the living space 1. The changes in the weightings V in Pattern C are shown in FIG. 13 (*c*), and the weightings V in the Pattern D are shown in FIG. 14 (*c*).

As a result, the energy conservation indices R for the living spaces 1 fir both of the Patterns C and D are corrected to the energy conservation indices R·V, indicated by the dotted lines in FIG. 13 (*a*) and FIG. 14 (*a*), where the energy conservation efficacy index TR for Pattern C is Obtained as a small value, obtained from TR=Σ(R·V) (referencing FIG. 13), and the energy conservation efficacy index TR for Pattern D that is obtained from TR=Σ(R·V) is obtained as a small value (referencing FIG. 14).

In this way, in the present example, in pattern C, wherein there are many occupants during the day, the energy conservation efficacy index TR will become a small value, and in Pattern D, wherein there are essentially no occupants during most of the daytime hours, the energy conservation efficacy index TR will become a large value, and thus it is possible to evaluate accurately the efficacy of the energy conservation in the living space 1 by taking into consideration the occupancy by residents such that, in Pattern C, the energy conservation efficacy is low (the amount of energy consumed is low, that is, there is low efficacy in the direction of low energy conservation (the degree of energy conservation is high)), and in Pattern D the energy conservation efficacy is high (there is a great deal of energy consumed, that is, there is high efficacy in the direction of reducing the energy conservation (the degree of energy conservation is low)).

Note that the energy conservation efficacy index TR calculated by the energy conservation efficacy index calculating portion 9-4 is displayed by the displaying portion 9-5, and thus the individual viewing this energy conservation efficacy index TR is able to determine whether or not there is the need to correct the controlling setting value or to renovate the equipment. In this case, various types of equipment, such as air-conditioning equipment or lighting equipment, can be considered as the "equipment," and various types of controlling setting values, such as air-conditioning controlling setting values and lighting controlling setting values, can be considered as the "controlling setting value." In this case, a threshold value to be used as a decision criterion may be displayed, and the decision as to whether or not the equipment requires renovation or the controlling setting value needs to be corrected may be performed through comparison with the threshold value. Furthermore, the comparison with the threshold value may be performed by the energy conservation efficacy index calculating portion 9-4, and the comparison result may be displayed on the displaying portion 9-5. Additionally, the energy conservation efficacy index TR of the living space 1 calculated by the energy conservation efficacy evaluating device 9 may be sent to a center through a communication network and the decision regarding the energy conservation efficacy index TR may be made on a screen at the center, and may be printed out as an operating report, or the like.

Additionally, in the example of embodiment set forth above, the measured value for the amount of energy consumed was used as-is as the energy conservation index R for the living space 1, but instead a conversion value for the carbon dioxide ($CO_2$) may be used as the energy conservation index R, or an evaluation formula that incorporates other related factors may be implemented. Furthermore, if an energy conservation target value is established, the level of achievement thereof may be used as the basis. In any case, implementation is made easier through the appropriate establishment of an energy conservation index R that has a value that is larger the less the level of energy conservation and that has a value that is smaller the greater the degree of energy conservation.

Furthermore, even in regards to the formula for calculating the energy conservation efficacy index TR, essentially this is a quantification method that takes into account the number of occupants, and Equation (7) and Equation (8) are no more than examples, and can be designed as appropriate. Moreover, while in Equation (7) and Equation (8) the weighting V was defined as V=1.0−0.8·(N/Nmax), and the factor (α) for multiplying (N/Nmax) was defined as 0.8, this factor α may be set to an arbitrary value in the range of $0<\alpha<1.0$.

Additionally, while in the examples, set forth above, the current occupancy information for the living space 1 for the comfort efficacy evaluating device 8 and the energy conservation efficacy evaluating device 9 was the occupancy information from a security system 7, instead individual PC operating information from a computer network system provided in the living space 1, or the like, may be used, or independent occupancy sensors may be provided in the living space 1 to detect the state of occupancy. Additionally, the weightings W and V used in the comfort efficacy evaluating device 8 and the energy conservation efficacy evaluating device 9 may be binary values established for the occupancy (the presence or absence of people) of the living space.

Furthermore, in the example comfort was defined as the added value and the efficacy thereof was evaluated, and in another example energy conservation was defined as the added value and the efficacy thereof was evaluated, there is no limitation to the added value being comfort or energy conservation in this way, hut rather the same method may be used for evaluating the efficacy of various different types of added values.

The living space added value efficacy index evaluating method and device according to the present invention are a method and a device for evaluating accurately the efficacy of added values such as comfort and energy conservation, in living spaces, and can be used in renovating equipment such as air-conditioning facilities and air-conditioning equipment in living spaces, and in correcting control setting values such as air-conditioning control setting values and lighting control setting values.

The invention claimed is:

1. A living space added value efficacy index evaluating method comprising:

a control status index acquiring step acquiring, by a control status index device, control status indices, each control status index indicating a present control status in a living space;

an occupancy status detecting step detecting, by a an occupancy status detector, current occupancy statuses in the living space, which correspond to the control status indices, respectively; and an added value efficacy index calculating step calculating, by an added value efficacy index calculator, an added value efficacy index that indicates efficacy of a specific added value by weighting the control status indices in accordance with the corresponding current occupancy statuses, and integrating the weighted control status indices within a specific interval established as an evaluation interval.

2. The living space added value efficacy index evaluating method as set forth in claim 1, wherein:

the control status index is defined as a comfort index that indicates the current control status of comfort within the living space.

3. The living space added value efficacy index evaluating method as set forth in claim 2, wherein:

The comfort index has a value that is larger when the comfort is higher and smaller when the comfort is lower: and the added value efficacy index calculating step integrates the weighted control status indices over the evaluation interval, wherein the weighting on the comfort index is large when the number of occupants in the living space is relatively high, and the weighting on the comfort index is small when the number of occupants is relatively small.

4. The living space added value efficacy index evaluating method as set forth in claim 3, wherein:

the added value efficacy index calculating step integrates the weighted control status indices over the evaluation interval, with the weighting in the comfort index established as W=N/Nmax, wherein a maximum expected number of occupants in the living space is defined as Nmax and the current number of occupants in the living space is defined as N.

5. The living space added value efficacy index evaluating method as set forth in claim 1, wherein:

the control status index is defined as an energy conservation index that indicates the current control status of energy conservation within the living space.

6. The living space added value efficacy index evaluating method as set forth in claim 5, wherein the energy conservation index has a value that is larger when the degree of potential improvement in energy conservation is larger and smaller when the degree of potential improvement in energy conservation is smaller: and the added value efficacy index calculating step integrates the weighted control status indices over the evaluation interval, wherein the weighting on the energy conservation index is small when the number of occupants in the living space is relatively high, and the weighting on the energy conservation index is large when the number of occupants is relatively small.

7. The living space added value efficacy index evaluating method as set forth in claim 6, wherein:

the control status index weighting step integrates the weighted control status indices over the evaluation interval, with the weighting in the comfort index established as $$V=1.0-\alpha\cdot(N/N\max)$$

wherein a maximum expected number of occupants in the living space is defined as Nmax, the current number of occupants in the living space is defined as N, and a factor is defined as $\alpha$ ($0<\alpha<1.0$).

8. The added value efficacy evaluating method as set forth in claim 1, wherein the occupancy status detecting step detects the current occupancy status in the living space based on information from an existing system equipped for the living space.

9. The added value efficacy evaluating method as set forth in claim 1, wherein:

the control status index acquiring step acquires the control status index as a reported value from a resident.

10. A living space added value efficacy index evaluating device comprising:

a control status index device acquiring control status indices, each control status index indicating a present control status in a living space;

an occupancy status detector detecting current occupancy statuses in the living space, which correspond to the control status indices, respectively; and an added value efficacy index calculator calculating an added value efficacy index that indicates efficacy of a specific added value by weighting the control status indices in accordance with the corresponding current occupancy statuses, and integrating the weighted control status indices within a specific interval established as an evaluation interval.

11. The living space added value efficacy index evaluating device as set forth in claim 10, wherein:

the control status index is defined as a comfort index that indicates the current control status of comfort within the living space.

12. The living space added value efficacy index evaluating device as set forth in claim 10, wherein:

the control status index is defined as an energy conservation index that indicates the current control status of energy conservation within the living space.

* * * * *